US008061361B2

(12) United States Patent
Maeder et al.

(10) Patent No.: US 8,061,361 B2
(45) Date of Patent: Nov. 22, 2011

(54) DISTILLATION-BASED SMOKING ARTICLE

(75) Inventors: Serge Maeder, Auvernier (CH); Jean-Jacques Piadé, Hauterive (CH); Laurent Edouard Poget, Bussigny (CH); Jacques Armand Zuber, Peseux (CH)

(73) Assignee: Philip Morris USA Inc., Richmond, VA (US)

( * ) Notice: Subject to any disclaimer, the term of this patent is extended or adjusted under 35 U.S.C. 154(b) by 775 days.

(21) Appl. No.: 12/222,418

(22) Filed: Aug. 8, 2008

(65) Prior Publication Data

US 2009/0065011 A1 Mar. 12, 2009

(30) Foreign Application Priority Data

Aug. 10, 2007 (EP) ..... 07253142

(51) Int. Cl.
*A24F 47/00* (2006.01)

(52) U.S. Cl. ..... 131/270; 131/194

(58) Field of Classification Search ..... None
See application file for complete search history.

(56) References Cited

U.S. PATENT DOCUMENTS

| | | | |
|---|---|---|---|
| 4,714,082 | A | 12/1987 | Banerjee |
| 5,040,551 | A | 8/1991 | Schlatter et al. |
| 5,040,552 | A | 8/1991 | Schleich et al. |
| 5,060,676 | A | 10/1991 | Hearn et al. |
| 5,146,934 | A | 9/1992 | Deevi et al. |
| 5,188,130 | A | 2/1993 | Hajaligol et al. |
| 5,240,012 | A | 8/1993 | Ehrman et al. |
| 5,240,014 | A | 8/1993 | Deevi et al. |
| 5,246,018 | A | 9/1993 | Deevi et al. |
| 5,247,949 | A | 9/1993 | Deevi et al. |
| 5,443,560 | A | 8/1995 | Deevi et al. |
| 5,468,266 | A | 11/1995 | Bensalem et al. |
| 5,479,949 | A | 1/1996 | Battard et al. |
| 5,595,577 | A | 1/1997 | Bensalem et al. |
| 6,378,528 | B1 | 4/2002 | Beeson et al. |

FOREIGN PATENT DOCUMENTS

| | | | |
|---|---|---|---|
| EP | 0545186 | A2 | 11/1992 |
| EP | 0535695 | A | 4/1993 |
| GB | 610225 | | 10/1948 |
| NZ | 230007 | | 7/1989 |

OTHER PUBLICATIONS

International Preliminary Report on Patentability issued Feb. 16, 2010 for PCT/IB2008/002868.
International Search Report and Written Opinion mailed Apr. 9, 2009 for PCT/IB2008/002868.
Examination Report dated Jun. 22, 2011 for New Zealand Appln. No. 582761.
European Search Report for European Application No. EP07253142 dated Jan. 10, 2008.

*Primary Examiner* — Richard Crispino
*Assistant Examiner* — Michael J Felton
(74) *Attorney, Agent, or Firm* — Buchanan Ingersoll & Rooney PC

(57) ABSTRACT

A smoking article comprises: a combustible heat source; an aerosol-generating substrate downstream of the combustible heat source; and a heat-conducting element around and in contact with a rear portion of the combustible heat source and an adjacent front of the aerosol-generating substrate. The aerosol-generating substrate extends at least about 3 mm downstream beyond the heat-conducting element.

20 Claims, 3 Drawing Sheets

DISTILLATION-BASED SMOKING ARTICLE

CROSS REFERENCE TO RELATED APPLICATION

This application claims priority under 35 U.S.C. §119 to European Application No. 07253142.9, filed Aug. 10, 2007, entitled DISTILLATION-BASED SMOKING ARTICLE, the entire content of which is hereby incorporated by reference.

SUMMARY

According to the invention there are provided distillation-based smoking articles comprising a combustible heat source, an aerosol-generating substrate downstream of the combustible heat source and a heat-conducting element around and in contact with a rear portion of the combustible heat source and an adjacent front portion of the aerosol-generating substrate. The distillation-based smoking articles are characterised in that the aerosol-generating substrate extends at least about 3 millimeters (mm) downstream beyond the heat-conducting element. This advantageously affects the consistency of the aerosol composition from puff to puff.

Preferred are cigarette-like distillation-based smoking articles that additionally comprise an expansion chamber downstream of the aerosol generating substrate or a mouthpiece or both

DETAILED DESCRIPTION

Figure 1:
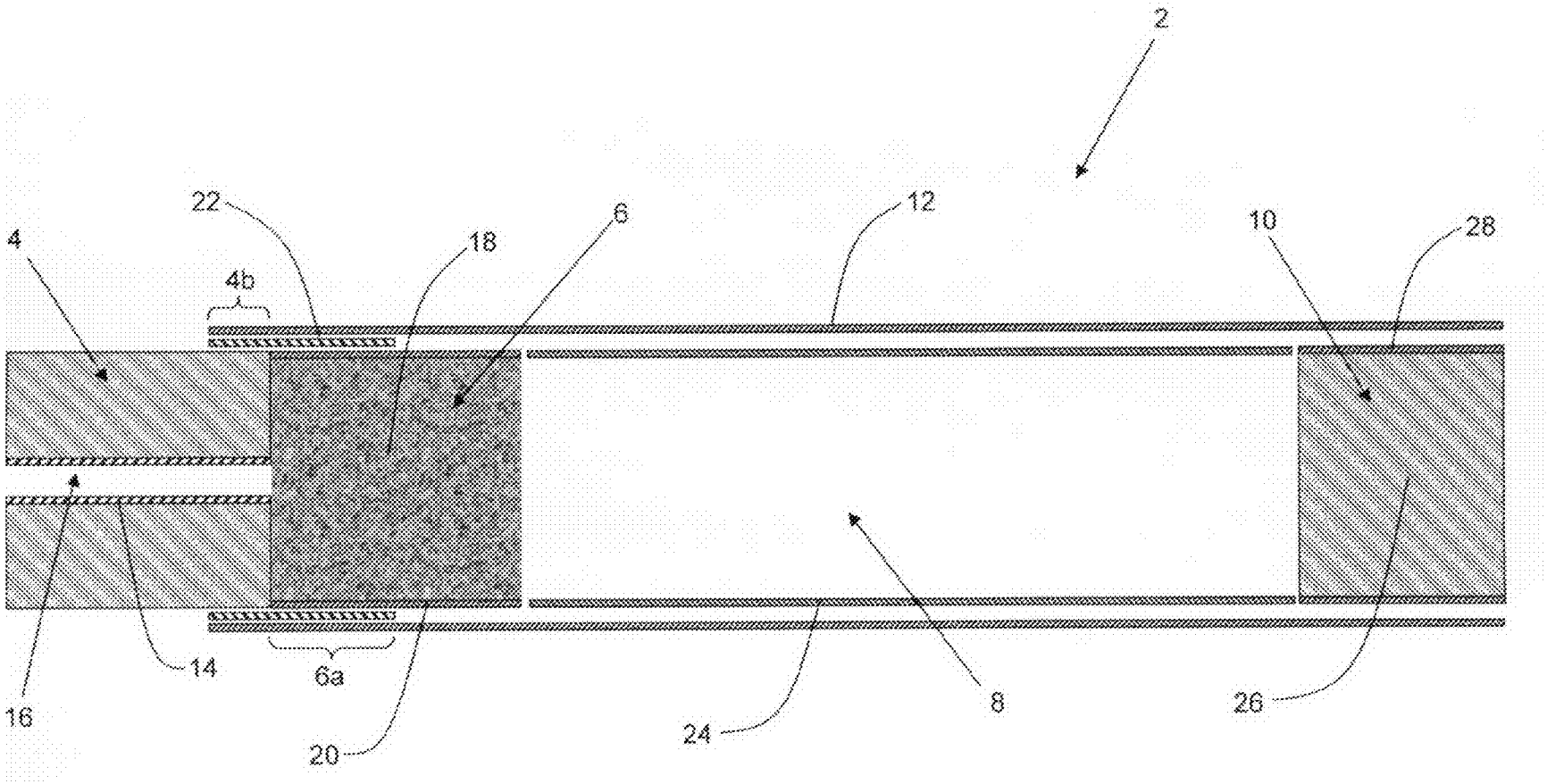
FIG. 1 shows a schematic longitudinal cross-section of a smoking article according to a first preferred embodiment of the invention having the dimensions and features given in column 1 of Table 1.

As used herein, the terms 'upstream' and 'front', and 'downstream' and 'rear', are used to describe the relative positions of components, or portions of components, of smoking articles of the invention in relation to the direction of air drawn through the smoking articles during use.

The rear portion of the combustible heat source is the portion of the heat source that is circumscribed by and in direct contact with the heat-conducting element.

The front portion of the aerosol-generating substrate is the portion of the substrate that is circumscribed by and in direct contact with the heat-conducting element.

The heat-conducting element is around and in direct contact with the peripheries of both the rear portion of the combustible heat source and the front portion of the aerosol-generating substrate. The heat-conducting element provides a thermal link between these two components of distillation-based smoking articles according to the invention.

As used herein, the term 'length' denotes the dimension in the longitudinal direction of the smoking article.

As used herein, the term 'operating temperature' refers to the surface temperature (in degrees Celsius) halfway along the front portion of the aerosol-generating substrate of distillation-based smoking articles according to the invention. In other words, the surface temperature at half-length of the front portion of the aerosol-generating substrate. It is measured during use at the surface of the smoking articles using an IR camera.

In smoking articles according to the invention, the periphery of the aerosol-generating substrate is partially covered by the heat-conducting element. While the heat-conducting element is wrapped around the periphery of the front portion of the aerosol-generating substrate, the periphery of the rear portion of the aerosol-generating substrate is not surrounded by the heat-conducting element. The length of the rear portion of the aerosol-generating substrate not surrounded by the heat-conducting element is at least about 3 mm or more.

The combustible heat source and the aerosol-generating substrate are substantially axially aligned. Preferably, the heat source and the aerosol-generating substrate abut against one another. This advantageously allows the surface of the aerosol-generating substrate abutting the combustible heat source to be heated by conductive heat transfer. The abutting surfaces of the rear portion of the heat source and the front portion of the substrate are preferably of substantially the same or the same cross-section. This advantageously maximises such conductive heat transfer.

Preferably, the heat-conducting element provides a substantially airtight connection between the combustible heat source and the aerosol-generating substrate. An airtight connection between the heat source and the substrate, in use, advantageously prevents combustion gases from the heat source being drawn into the aerosol-generating substrate through its periphery. Furthermore, such a connection minimises or substantially avoids convective heat transfer from the combustible heat source to the aerosol-generating substrate by hot air drawn along the periphery.

In addition, the airtightness of the connection helps to minimise elevation of the combustion temperature of the heat source during puffing.

In distillation-based smoking articles according to the invention, the heat-conducting element transfers heat generated during combustion of the heat source to the aerosol-generating substrate via conduction. The heat-conducting element significantly impacts the temperature of the rear portion of the heat source. The rear end of the heat source is adjacent to, and preferably abuts against, the front end of the aerosol-generating substrate. The heat drain exerted by the conductive heat transfer significantly lowers the temperature of the rear portion of the combustible heat source. As a result, in use, the temperature of the rear portion of the combustible heat source is kept significantly below its self-ignition temperature. Consequently, no part of the aerosol-generating substrate is ever in contact with or adjacent to a combusting or exceedingly hot portion of the combustible heat source. This enables combustion as well as intense pyrolysis of the aerosol-generating substrate to be avoided. Generally, the longer the rear portion of the combustible heat source, the lower the temperature at the interface between the combustible heat source and the aerosol-generating substrate. The coverage of the rear portion of the combustible heat source by the heat-conducting element also advantageously ensures that the combustible heat source is held in place relative to the other components of the smoking article during combustion.

In distillation-based smoking articles according to the invention, the operating temperature has a significant impact on the ability to generate a sensorially acceptable aerosol while avoiding formation of undesirable compounds through combustion or pyrolytic degradation of the aerosol-generating substrate. The operating temperature is advantageously kept within a narrow range. The maximum operating temperature is advantageously lower than the temperature at which pyrolytically formed harmful smoke constituents become noticeable and should not exceed this temperature under a broad range of puffing conditions that may realistically be adopted by a consumer. The minimum operating temperature is advantageously given by the temperature at which volatile organic aroma and flavour compounds are generated from the aerosol-generating substrate in sufficient quantities to produce a sensorially acceptable aerosol. The operating temperature may be controlled by choosing the length of the rear portion of the combustible heat source and the length of the front portion of the aerosol-generating substrate (and hence, for a given length of the aerosol-generating substrate, the length of its rear portion). Carefully controlling and managing the operating temperature in this manner advantageously allows, for example, optimisation of the composition, and hence the sensorial acceptability of the aerosols generated by smoking articles according to the invention.

Distillation-based smoking articles of the invention are constructed such that heat transfer from the combustible heat source to the aerosol-generating substrate is primarily achieved by conductive heat transfer. However, a controlled amount of convective heat transfer from the combustible heat source to the aerosol-generating substrate is also provided in order to avoid excessive cooling of the aerosol-generating substrate during puffing. The design of smoking articles according to the invention advantageously allows the proportion of heat transfer from the combustible heat source to the aerosol-generating substrate by conduction on the one hand and by convection on the other hand to be readily adjusted and independently controlled.

According to the invention a preferred way to provide a controlled amount of convective heating of the aerosol-generating substrate is by means of at least one longitudinal airflow channel through the combustible heat source. The convective heat transfer from the combustible heat source to the aerosol-generating substrate during puffing is preferably just sufficient to prevent significant cooling of the aerosol-generating substrate during puffing and to compensate for the latent heat of evaporation of the volatile compounds released from the aerosol-generating substrate. Where it is desired to reduce the convective heat transfer, the inner surface of the at least one airflow channel may be coated. The coating may advantageously reduce or substantially prevent the inflow of combustion by-products from the combustible heat source into the airflow channel or channels. Furthermore, the coating may advantageously reduce or prevent the activation of combustion of the heat source during puffing. Through the careful selection of parameters relating to the at least one airflow channel, the convective heat transfer from the combustible heat source to the aerosol-generating substrate may be kept low during even quite extreme puffing regimes. Such parameters include the number of airflow channels, the dimensions of the airflow channels, as determined by channel diameter and channel length, as well as the length, thickness and thermal conductivity of the coating.

In smoking articles according to the invention, heat is generated through combustion of a solid heat source. The combustible heat source may comprise any suitable combustible fuel including, but not limited to, carbon, aluminium, magnesium, carbides, nitrides and mixtures thereof. Preferred are combustible fuels with a high heat generating capacity, which produce very low amounts of incomplete combustion by-products and which provide for sufficient mechanical strength of the combustible heat source.

Suitable combustible heat sources for use in smoking articles according to the invention, and methods for producing such heat sources, are well known in the art and described in, for example, U.S. Pat. No. 5,040,552, U.S. Pat. No. 5,060,676, U.S. Pat. No. 5,146,934, U.S. Pat. No. 5,188,130, U.S. Pat. No. 5,240,014, U.S. Pat. No. 5,246,018, U.S. Pat. No. 5,247,949, U.S. Pat. No. 5,443,560, U.S. Pat. No. 5,468,266 and U.S. Pat. No. 5,595,577.

Preferred combustible heat sources for use in the invention are carbon-based, that is they comprise primarily carbon.

To reduce and minimise the delivery of undesirable carbon monoxide to the consumer, carbon monoxide generated from combustion of the heat source may be removed, preferably by catalytic conversion. For example, the removal of carbon monoxide may be effected by using a combustible heat source comprising a catalyst that is capable of converting carbon monoxide into carbon dioxide. Alternatively, such a catalyst may be located immediately behind the heat source.

Alternatively and more preferably, the combustible heat source is a porous carbon-based heat source. The structure of the porous carbon-based heat source is preferably such that substantially no air can be drawn through the heat source during puffing (in the absence of an airflow channel). The porosity of the combustible heat source has a substantial impact on its combustion rate. As the combustion proceeds, oxygen may diffuse into the mass of the heat source at a rate sufficient to sustain combustion.

Most preferred for use in smoking articles according to the invention are combustible heat sources that are pyrolysed, porous and carbon-based. Advantageously, such combustible heat sources have a geometric density of between about 0.5 $g/cm^3$ and about 0.8 $g/cm^3$. Such combustible heat sources preferably have a porosity of between about 60 percent and about 65 percent. The desired porosity may be readily achieved during manufacturing of the combustible heat source using conventional methods and technology.

Preferably, the combustible heat sources of distillation-based smoking articles according to the invention are of substantially uniform diameter. Alternatively, the combustible heat sources may be tapered so that the diameter of the rear portion of the combustible heat source is greater than the diameter of the front portion thereof. Particularly preferred are combustible heat sources that are substantially cylindrical. The combustible heat sources may, for example, be a cylinder or tapered cylinder of substantially circular cross-section or a cylinder or tapered cylinder of substantially elliptical cross-section.

Advantageously, the front portion of the heat source, that is the portion not surrounded by the heat-conducting element, may be ignited along its entire length. To indicate to a consumer the optimum position at which to ignite the combustible heat source, one or more marks may be advantageously provided on the combustible heat source of smoking articles according to the invention. For example, a circumferential groove, notch or other suitable indicator may be provided on the combustible heat source to indicate the position at which the consumer should preferably ignite the combustible heat source.

Combustible heat sources for use in smoking articles according to the invention may be produced using known ceramic forming methods such as, for example, slip casting, extrusion, injection moulding and die compaction. Where the combustible heat source is a carbon-based heat source, it is preferably pyrolysed after the forming process. If desired, organic binders may be used in the forming process. Additives may also be included, for example, additives to promote consolidation of the combustible heat source (for example sintering aids), additives to promote combustion of the heat source (for example potassium) and additives to promote decomposition of one or more gases produced by combustion of the heat source (for example catalysts). Oxidants may be added after pyrolysis to improve combustion lighting properties of the heat source.

Preferably, the combustible heat sources of distillation-based smoking articles of the invention comprise at least one longitudinal airflow channel, that is a hole passing through an inner portion of the heat source and extending along the entire length of the heat source. More preferably, the combustible heat sources comprise one, two or three longitudinal airflow channels. Most preferably, a single longitudinal airflow channel is provided through the combustible heat source. In particularly preferred embodiments of the invention, the combustible heat source comprises a single substantially central or axial airflow channel. The diameter of the single airflow channel is preferably between about 1.5 mm and about 3 mm, more preferably between about 2 mm and about 2.5 mm.

Advantageously, the design of the heat source is such that air which is drawn into the aerosol-generating substrate and further downstream during puffing does not come into contact with a zone of the combustible heat source where carbon monoxide is produced, for example the combustion zone.

The inner surface of the at least one longitudinal airflow channel may be partially or entirely coated. Preferably, the coating comprises a layer of solid particulate matter and is substantially air impermeable. In preferred embodiments of the invention, the coating covers at least the part of each longitudinal airflow channel that extends through the front portion of the combustible heat source, that is the portion of the combustible heat source that is not surrounded by the heat-conducting element. Preferably, the coating covers the inner surface of all airflow channels. Advantageously, the substantially air impermeable coating is of low thermal conductivity. The coating may be formed from one or more suitable materials that are substantially thermally stable and non-combustible at the combustion temperature of the heat source. Suitable materials are known in the art and include, for example, clays, metal oxides, such as iron oxide, alumina, titania, silica, silica-alumina, zirconia and ceria, zeolites, zirconium phosphate and other ceramic materials or combinations thereof. Preferred coating materials include clays and iron oxide. If desired, catalytic ingredients, such as ingredients that promote the oxidation of carbon monoxide to carbon dioxide, may be incorporated in the coating material. Suitable catalytic ingredients include, for example, platinum, palladium, transition metals and their oxides.

Preferably, the coating has a thickness of between about 30 microns and about 200 microns, more preferably of between about 30 microns and about 100 microns.

The coating may be applied to the inner surface of the at least one longitudinal airflow channel by any suitable method, such as the methods described in U.S. Pat. No. 5,040,551. For example, the inner surface of each longitudinal airflow channel may be sprayed, wetted or painted with a solution or a suspension of the coating. Alternatively, the coating may be provided by insertion of a liner into one or more longitudinal airflow channels. For example, a substantially air impermeable hollow tube may be inserted into each longitudinal airflow channel.

Optionally, the combustible heat sources of smoking articles according to the invention may comprise one or more, preferably up to and including six, longitudinal grooves that extend along part of or all of the periphery of the combustible heat sources. In smoking articles according to the invention comprising such grooved combustible heat sources, the heat-conducting element is in contact with the protruding periphery of the rear portion of the combustible heat sources; the connection between the combustible heat source and the aerosol-generating substrate may not be airtight. If desired, the combustible heat sources of smoking articles according to the invention may comprise at least one longitudinal airflow channel and one or more longitudinal grooves.

The aerosol-generating substrates of distillation-based smoking articles according to the invention comprise at least one aerosol former and a material capable of emitting volatile compounds in response to heating. The aerosol may be visible or invisible and includes vapours as well as gases and liquid droplets of condensed vapours.

The at least one aerosol former may be any suitable known compound or mixture of compounds that, in use, facilitates formation of a dense and stable aerosol and that is substantially resistant to thermal degradation at the operating temperature. The operating temperature is advantageously consistently high enough to release sufficient amounts of the at least one aerosol former. The boiling point of the aerosol former, or of the mixture of aerosol formers, is preferably less than about 350° C. Suitable aerosol formers are well known to those in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in the present invention are polyhydric alcohols or mixtures thereof, such as triethylene glycol, 1,3-butanediol and, most preferred, glycerine.

Preferably, the material capable of emitting volatile compounds in response to heating is a charge of plant-based material, more preferably a charge of homogenised plant-based material. For example, the aerosol-generating substrate may comprise one or more materials derived from plants including, but not limited to, tobacco, tea, for example green tea, peppermint, laurel, eucalyptus, basil, sage, verbena and tarragon. The plant based-material may comprise additives including, but not limited to, humectants, flavourants, binders and mixtures thereof.

Advantageously, the plant-based material is circumscribed by a suitable wrapper of, for example, paper, such as filter plug wrap. Such wrapper may serve to facilitate the assembly of the smoking article and advantageously has little or substantially no impact on the heat transfer from the heat-conducting element to the aerosol-generating substrate. If desired, the wrapper may contribute to the emission of volatile compounds. For example, the wrapper may be a web of tobacco. According to the present invention, more preferred are distillation-based smoking articles wherein the plant-based material comprised in the aerosol-generating substrate consists essentially of tobacco material, most preferably homogenised tobacco material. The tobacco material may be in the form of shreds, beads, pellets, filaments or mixtures thereof. Preferably, the tobacco material comprises between about 5% and about 40% aerosol former by weight, more preferably between about 10% and about 20% aerosol former by weight. Methods for providing tobacco material with such loadings of aerosol former are known in the art and described, for example, in U.S. Pat. No. 6,378,528.

Most preferably, the aerosol-generating substrate comprises an aerosol former, such as glycerine, and a plug of homogenised tobacco material, such as reconstituted tobacco, cast sheet tobacco, extruded tobacco, or a mixture thereof, circumscribed by filter plug wrap. The geometric density of the homogenised tobacco material is preferably greater than the geometric density of tobacco cut filler in conventional cigarettes. In preferred embodiments of the invention, the geometric density of the homogenised tobacco material including the aerosol former is at least about 0.4 $mg/mm^3$ or more. Advantageously, the geometric density of the homogenised tobacco material including the aerosol former is below about 1.2 $mg/mm^3$.

If desired, the tobacco material may comprise suitable additives including, but not limited to, humectants, flavourants, binders and mixtures thereof. For example, if appropriate, a binder may be used to stabilise a polyhydric alcohol used as an aerosol former as disclosed, for example, in EP-A-0545186. The operating temperature of aerosol-generating substrates comprising glycerine and homogenised tobacco material is preferably controlled such that it does not exceed about 300° C. Most preferably, the operating temperature is between about 200° C. and about 250° C.

Alternatively, or in addition to tobacco or other plant-based material, the aerosol-generating substrate may comprise an inert carrier material impregnated or otherwise loaded with one or more flavourants, which evaporate at the operating temperature. The inert carrier material may be any suitable known material that is substantially thermally stable at the operating temperature of the distillation-based smoking article including, but not limited to porous ceramic materials or naturally occurring or synthetic polymeric materials such as cellulose and chemically modified cellulose. For example, the aerosol-generating substrate may comprise tobacco-based material, such as a tobacco-derived extract or a tobacco-based paste, cast or coated onto an inert web or support.

Advantageously, the aerosol-generating substrate is substantially cylindrical in shape and of substantially uniform cross-section. The cross-section may, for example, be substantially circular or substantially elliptical.

Preferably, the heat-conducting element forms a thin continuous sleeve, which tightly circumscribes the rear portion of the heat source and the front portion of the aerosol-generating substrate. The heat-conducting element may be made of any suitable heat-resistant material or combination of materials with an appropriate thermal conductivity. Preferably, the heat-conducting element has a thermal conductivity of between about 10 W/m·K and about 500 W/m·K, more preferably of between about 15 W/m·K and about 400 W/m·K. Advantageously, the material is easily foldable and suitable for use on conventional cigarette making equipment. For example, the heat-conducting element may be formed of one or more metals, one or more alloys, or combinations thereof. More preferably, the heat-conducting element is formed of aluminium, most preferably of aluminium foil. Preferably, the heat-conducting element has a thickness of between about 5 microns and about 50 microns, preferably of between about 10 microns and about 30 microns. Most preferably, the heat-conducting element is an aluminium foil having a thickness of about 20 microns.

In preferred embodiments of the invention, the heat-conducting element surrounds between about 30 percent and about 60 percent of the length of the aerosol-generating substrate.

While distillation-based smoking articles wherein the rear portion of the combustible heat source and the front portion of the aerosol-generating substrate abut against one another are preferred, smoking articles wherein the rear portion of the combustible heat source and the front portion of the aerosol-generating substrate are spaced apart are also within the scope of the invention. In such embodiments, the gap or separation between the combustible heat source and the aerosol-generating substrate in the longitudinal direction of the smoking article is preferably less than about 2 mm, more preferably about 0.5 mm. Optionally, a flavour source may be provided between the rear portion of the combustible heat source and the front portion of the aerosol-generating substrate. For example, to enhance the flavour of puffs taken shortly after ignition of the combustible heat source, a flavour source comprising one or more flavourants having a higher volatility than the volatile compounds in the aerosol-generating substrate may advantageously be provided between the rear portion of the combustible heat source and the front portion of the aerosol-generating substrate.

Optionally, smoking articles according to the invention may further comprise a sleeve around part of the rear portion of the aerosol-generating substrate. The sleeve is downstream of and spaced apart from the heat-conducting element. The gap or separation between the heat-conducting element and the sleeve is at least about 0.5 mm or more. The sleeve may serve as a barrier material and prevent migration of the aerosol former to the outer surface of the smoking article. Alternatively or in addition, the sleeve may serve to slightly modulate the steepness of the temperature gradient along the length of the aerosol-generating substrate by retaining heat in the rear portion of the aerosol-generating substrate and thus slightly reducing the steepness of the temperature gradient. However, the sleeve has only a small impact on the steepness of said gradient. The sleeve may be formed of the same material as or different material to the heat-conducting element. Advantageously, the sleeve is of about the same thickness as the heat-conducting element.

Smoking articles according to the invention may also further comprise an expansion chamber downstream of the aerosol-generating substrate. The inclusion of an expansion chamber advantageously allows further cooling of the aerosol generated by heat transfer from the combustible heat source to the aerosol-generating substrate while there is minimal or no filtration of the droplet particulate phase. The expansion chamber also advantageously allows the overall length of smoking articles according to the invention to be adjusted to a desired value, for example to a length similar to that of conventional cigarettes, through an appropriate choice of the length of the expansion chamber. Preferably, the expansion chamber is an elongate hollow tube, which is advantageously of substantially uniform cross-section. For example, the expansion chamber may comprise a hollow cardboard tube, a hollow tube of cellulose acetate tow or both. The expansion chamber provides a link or bridge between the aerosol-generating substrate and the mouth end of smoking articles according to the invention.

Smoking articles according to the invention may also further comprise an integral mouthpiece downstream of the aerosol-generating substrate and, where present, downstream of the expansion chamber. The integral mouthpiece may, for example, comprise a filter having one or more segments. The filter may comprise one or more segments of cellulose acetate, paper or other suitable known filtration materials. Preferably, the integral mouthpiece is of low filtration efficiency, more preferably of very low filtration efficiency. Alternatively or in addition, the filter may comprise one or more segments comprising absorbents, adsorbents, flavourants, and other aerosol modifiers and additives used in filters for conventional cigarettes, or combinations thereof.

If desired, ventilation may be provided at a location downstream of the combustible heat source of smoking articles according to the invention. For example, where present, ventilation may be provided at a location along the integral mouthpiece of smoking articles according to the invention.

Instead of, or in addition to, being provided with an integral mouthpiece, smoking articles according to the invention may be provided for use in conjunction with a separate mouthpiece. In an embodiment, smoking articles according to the invention may be provided for use in conjunction with a reusable separate mouthpiece. For example, a kit may be provided including: (i) at least one smoking article according to the invention; and (ii) a reusable separate mouthpiece for use in conjunction with the at least one smoking article according to the invention. The use of a reusable separate mouthpiece with a smoking article according to the invention advantageously reduces the quantity of waste materials that must be discarded after the smoking article is consumed. In an alternative embodiment, smoking articles according to the invention may be provided for use in conjunction with a disposable separate mouthpiece.

Smoking articles according to the invention may be used in conjunction with any suitable separate mouthpiece. Separate mouthpieces for use with smoking articles in which tobacco is heated rather than combusted, which are suitable for use with smoking articles according to the invention, are known in the art. For example, U.S. Pat. No. 5,240,012 discloses a smoking article comprising a combustible heat source, a flavor producing means and a reusable body.

Separate mouthpieces for use with conventional cigarettes and other smoking articles in which tobacco is combusted, which are suitable for use with smoking articles according to the invention, are also known in the art. For example, GB-A-610,225 discloses a cigarette holder comprising a mouthpiece having an axial bore, a removable extension to the bore of the mouthpiece. a sleeve member removably engaging the mouthpiece and surrounding the extension, and a cigarette holding portion disposed within the sleeve.

Smoking articles according to the invention are preferably detachably secured to a separate mouthpiece by an interference fit.

Smoking articles according to the invention may be manually removed from a separate mouthpiece after use. However, smoking articles according to the invention are preferably used in conjunction with a separate mouthpiece comprising an ejection mechanism operable by a consumer to eject the smoking article from the separate mouthpiece after use. The use of a separate mouthpiece comprising an ejection mechanism advantageously reduces or eliminates the need for the consumer to touch the smoking article according to the invention in order to remove the smoking article from the separate mouthpiece.

Ejection mechanisms suitable for inclusion in separate mouthpieces for use in conjunction with smoking articles according to the invention are known in the art. For example, the reusable body of the smoking article described in U.S. Pat. No. 5,240,012 includes ejector means to facilitate detachment of the combustible heat source and flavor producing means from the body by translating the ejector means a predetermined distance with respect to the body in a longitudinal direction.

The separate mouthpiece may comprise a filter having one or more segments. The filter may comprise one or more segments of cellulose acetate, paper or other suitable known filtration materials. Preferably, the separate mouthpiece is of low filtration efficiency, more preferably of very low filtration efficiency. Alternatively or in addition, the filter may comprise one or more segments comprising absorbents, adsorbents, flavourants, and other aerosol modifiers and additives used in filters for conventional cigarettes, or combinations thereof.

Smoking articles according to the invention may further comprise a flavour source downstream of the aerosol-generating substrate. Where smoking articles according to the invention further comprise an expansion chamber and a flavour source, the flavour source may be located downstream of the expansion chamber. Alternatively or in addition, the flavour source may be incorporated into, absorbed or adsorbed to the material forming the expansion chamber, or, where the expansion chamber is a hollow tube, the flavour source may be located within the expansion chamber. The flavour source may comprise an inert carrier material, for example an inert carrier material mentioned above, impregnated with one or more flavourants, aerosol formers or combinations thereof. Alternatively, or in addition, the flavour source may comprise tobacco-based material including, but not limited to tobacco cut filler, homogenised tobacco (such as reconstituted tobacco, extruded tobacco or cast sheet tobacco) and tobacco-based or tobacco-derived extracts. The aerosol-generating substrate and the flavour source may comprise the same or different aerosol formers.

One or more of the combustible heat source, the aerosol-generating substrate and, where included, the sleeve, the expansion chamber and the mouthpiece of smoking articles according to the invention may comprise one or more flavourants. The flavourants may be natural extracts, synthetic flavours, or a combination thereof. Flavourants that may be included in smoking articles according to the invention include, but are not limited to, menthol, spearmint, peppermint, eucalyptus, vanilla, cocoa, chocolate, coffee, tea, spices (such as cinnamon, clove and ginger) and fruit flavourants. For example, to enhance the flavour of puffs taken shortly after ignition of the combustible heat source of smoking articles according to the invention, one or more flavourants may be absorbed or otherwise provided on or close to the rear portion of the combustible heat source. For example, one or more flavourants may be applied to the rear end surface of the combustible heat source. Alternatively or in addition, one or more flavourants may be applied to the inner surface of the heat-conducting element, for example by adding it to an adhesive, which may be used to attach the heat-conducting element to the rear portion of the combustible heat source. Generally, the combustible heat source, the aerosol-generating substrate and, where included, the sleeve, the expansion chamber and the mouthpiece of smoking articles according to the invention may include the same or different flavourants.

Preferably, the heat-conducting element, the aerosol-generating substrate and, where present, the sleeve, the expansion chamber and the mouthpiece, of smoking articles according to the invention are circumscribed by an outer wrapper of, for example, cigarette paper. More preferably, the heat-conducting element, the aerosol-generating substrate and, where present, the sleeve, the expansion chamber and the mouthpiece, of smoking articles according to the invention are circumscribed by an outer wrapper with odorising properties.

In a particular preferred embodiment, the heat-conducting element, the aerosol-generating substrate and, where present, the sleeve, the expansion chamber and the mouthpiece, of smoking articles according to the invention are circumscribed by an outer wrapper comprising encapsulated or complexed odorants, which are released during use of the smoking article as a result of thermal degradation. For example, smoking articles according to the invention may advantageously comprise outer wrappers comprising β-cyclodextrin inclusion complexes of the type described in U.S. Pat. No. 5,479,949.

In embodiments of the invention, the front portion of the combustible heat source may also be circumscribed by the outer wrapper. In such embodiments, the portion of the outer wrapper circumscribing the front portion of the combustible heat source of the smoking article is preferably removed by the consumer prior to use of the smoking article. Preferably, the outer wrapper comprises a cut, a line of perforations or other line of weakness, or a tear tape to allow the portion of the outer wrapper circumscribing the front portion of the combustible heat source of the smoking article to be removed by the consumer. Where the outer wrapper comprises a line of perforations or other line of weakness, a pull-tab is preferably provided in a seam of the outer wrapper proximate the line of weakness to facilitate removal of the portion of the outer wrapper circumscribing the front portion of the combustible heat source of the smoking article.

Removal of the portion of the outer wrapper circumscribing the front portion of the combustible heat source advantageously facilitates ignition of the combustible heat source by the consumer. In alternative embodiments of the invention, the front portion of the combustible heat source protrudes from the outer wrapper.

All or a portion of the outer wrapper may be coloured.

According to the invention, particularly preferred are distillation-based smoking articles that have similar or substantially the same dimensions as conventional cigarettes. Such smoking articles according to the invention preferably have a length of between about 70 mm and about 100 mm, more preferably of between about 70 mm and about 85 mm, most preferably of between about 70 mm and about 73 mm.

According to the invention, also particularly preferred are distillation-based smoking articles for use in conjunction with a separate mouthpiece. Such smoking articles according to the invention preferably have a length of between about 30 mm and about 50 mm, more preferably of between about 35 mm and about 45 mm.

Smoking articles according to the invention may be used in conjunction with separate mouthpieces of any desired length. Preferably, the length of the separate mouthpiece is such that, in use, the combined length of the smoking article according to the invention and the separate mouthpiece is between about 70 mm and about 100 mm, more preferably between about 74 mm and about 80 mm, most preferably about 84 mm.

The combustible heat sources of smoking articles according to the invention preferably have a length of between about 7 mm and about 17 mm, more preferably of between about 11 mm and about 15 mm, most preferably of about 11 mm. The length of the combustible heat source that may be combusted is an important factor in the design of smoking articles according to the invention. Preferably, the front portion of the combustible heat source is between about 5 mm and about 15 mm in length, more preferably between about 6 mm and about 8 mm in length. Preferably, the rear portion of the combustible heat source surrounded by the heat-conducting element is between about 2 mm and about 8 mm in length, more preferably between about 3 mm and about 5 mm in length.

The aerosol-generating substrate preferably has a length of between about 5 mm and about 20 mm, more preferably of between about 8 mm and about 12 mm. The length of the front portion of the aerosol-generating substrate is advantageously minimised to reduce the length of time required after ignition of the combustible heat source for part of the aerosol-generating substrate to reach a sufficient temperature for a sensorially acceptable aerosol to be produced. Preferably, the front portion of the aerosol-generating substrate is at least between about 2 mm and about 10 mm in length, more preferably between about 3 mm and about 8 mm in length, most preferably between about 4 mm and about 6 mm in length. Preferably, the rear portion of the aerosol-generating substrate not surrounded by the heat-conducting element is between about 3 mm and about 10 mm in length. In other words, the aerosol-generating substrate preferably extends between about 3 mm and about 10 mm downstream beyond the heat-conducting element. More preferably, the aerosol-generating substrate extends at least about 4 mm downstream beyond the heat-conducting element.

Preferably, the heat-conducting element has a length of between about 4 mm and about 13 mm, more preferably of between about 8 mm and about 10 mm, most preferably of about 9 mm.

For example, in one embodiment of the invention, the aerosol-generating substrate has a length of about 10 mm and the front portion of the aerosol-generating substrate is about 5 mm in length. The aerosol-generating substrate therefore extends about 5 mm downstream beyond the heat-conducting element. In another embodiment of the invention, the aerosol-generating substrate has a length of about 15 mm and the front portion of the aerosol-generating substrate surrounded by the heat-conducting element is about 6 mm in length. The aerosol-generating substrate therefore extends about 9 mm downstream beyond the heat-conducting element.

Where the rear portion of the aerosol-generating substrate is surrounded by a sleeve, the sleeve preferably is between about 3 mm and about 14 mm in length.

Where smoking articles according to the invention are not intended for use in conjunction with a separate mouthpiece, the expansion chamber preferably has a length of between about 30 mm and about 80 mm.

Where smoking articles according to the invention are intended for use in conjunction with a separate mouthpiece, the expansion chamber preferably has a length of between about 5 mm and about 20 mm.

Preferably, smoking articles according to the invention are of substantially uniform diameter. In certain preferred embodiments, smoking articles according to the invention have a diameter of between about 5 mm and about 9 mm, more preferably of between about 7 mm and about 8 mm. In alternative preferred embodiments, smoking articles according to the invention have a diameter of between about 4 mm and about 8 mm, more preferably of between about 5 mm and about 7 mm.

The diameter of smoking articles according to the invention is advantageously substantially equal to the diameter of the aerosol-generating substrates thereof. The diameter of smoking articles according to the invention is advantageously also substantially equal to the diameter of at least the rear portion of the combustible heat source thereof.

Smoking articles according to the invention may be assembled using known methods and machinery.

The cigarette-like smoking article 2 according to the first preferred embodiment of the invention shown in FIG. 1 comprises a combustible heat source 4, an aerosol-generating substrate 6, an elongate expansion chamber 8 and a mouthpiece 10 in abutting coaxial alignment, which are overwrapped in an outer wrapper of cigarette paper 12 of low air permeability.

The combustible heat-source 4 is a pyrolised porous carbon-based heat source. The combustible heat source 4 is cylindrical and comprises a central airflow channel 16 that extends longitudinally through the combustible heat source 4.

A substantially air impermeable, heat resistant coating 14 of iron oxide is provided on the inner surface of the central airflow channel 16.

The aerosol-generating substrate 6 is located immediately downstream of the combustible heat source 4 and comprises a cylindrical plug of homogenised tobacco material 18 comprising glycerine as aerosol former and circumscribed by filter plug wrap 20. The homogenised tobacco material 18 consists of longitudinally aligned filaments of extruded tobacco material.

A heat-conducting element 22 consisting of a tube of aluminium foil surrounds and is in contact with a rear portion 4*b* of the combustible heat source 4 and an abutting front portion 6*a* of the aerosol-generating substrate 6. As shown in FIG. 1, a rear portion of the aerosol-generating substrate 6 is not surrounded by the heat-conducting element 22.

The elongate expansion chamber 8 is located downstream of the aerosol-generating substrate 6 and comprises a cylindrical open-ended tube of cardboard 24. The mouthpiece 10 of the smoking article 2 is located downstream of the expansion chamber 8 and comprises a cylindrical plug of cellulose acetate tow 26 of very low filtration efficiency circumscribed by filter plug wrap 28. The mouthpiece 10 may be circumscribed by tipping paper (not shown). The dimensions and further features of the cigarette-like smoking article 2 and its components are given in Table 1 (see column 1).

In use, the consumer ignites the combustible carbon-based heat source 4 and then draws air through the central airflow channel 16 downstream towards the mouthpiece 10. The front portion 6*a* of the aerosol-generating substrate 6 is heated primarily by conduction through the abutting non-combusting rear portion 4*b* of the combustible heat source 4 and the heat-conducting element 22. The drawn air is heated as it passes through the central airflow channel 16 and then heats the aerosol-generating substrate 6 by convection. The heating of the aerosol-generating substrate 6 releases volatile and semi-volatile compounds and glycerine from the aerosol-generating substrate 18, which are entrained in the heated drawn air as it flows through the aerosol-generating substrate. The heated air and entrained compounds pass downstream through the expansion chamber 8, cool and condense to form an aerosol that passes through the mouthpiece into the mouth of the consumer (at about ambient temperature).

The heat source 4 is made by mixing powdered carbon with a potassium-containing burn modifier and an organic binder system in water. The resulting dough is shaped into a cylindrical rod in the green state, which comprises a central airflow channel. The layer of substantially air impermeable, heat resistant coating on the inner surface of the central airflow channel is formed during extrusion of the rod in the green state by applying a suspension comprising solid iron oxide particles. The rod in the green state is dried and pyrolised at about 750° C. under an inert atmosphere and then cut to yield several cylindrical heat sources 4 of the desired length. Preformed rods of the aerosol-generating substrate are cut into several cylindrical plugs of the desired length.

To make the smoking article 2, a rectangular piece of the heat-conducting element 22 is glued to cigarette paper 12. The heat source 4, the plug of the aerosol-generating substrate 6 and the expansion chamber 8 are suitably aligned and positioned on the cigarette paper 12 with the attached heat-conducting element 22. The cigarette paper 12 with the attached heat-conducting element 22 is wrapped around the rear portion 4*b* of the heat source 4, the aerosol-generating substrate 6 and the expansion chamber 8 and glued. The mouthpiece 10 is attached to the open end of the expansion chamber using known filter combining technology.

Figure 2:
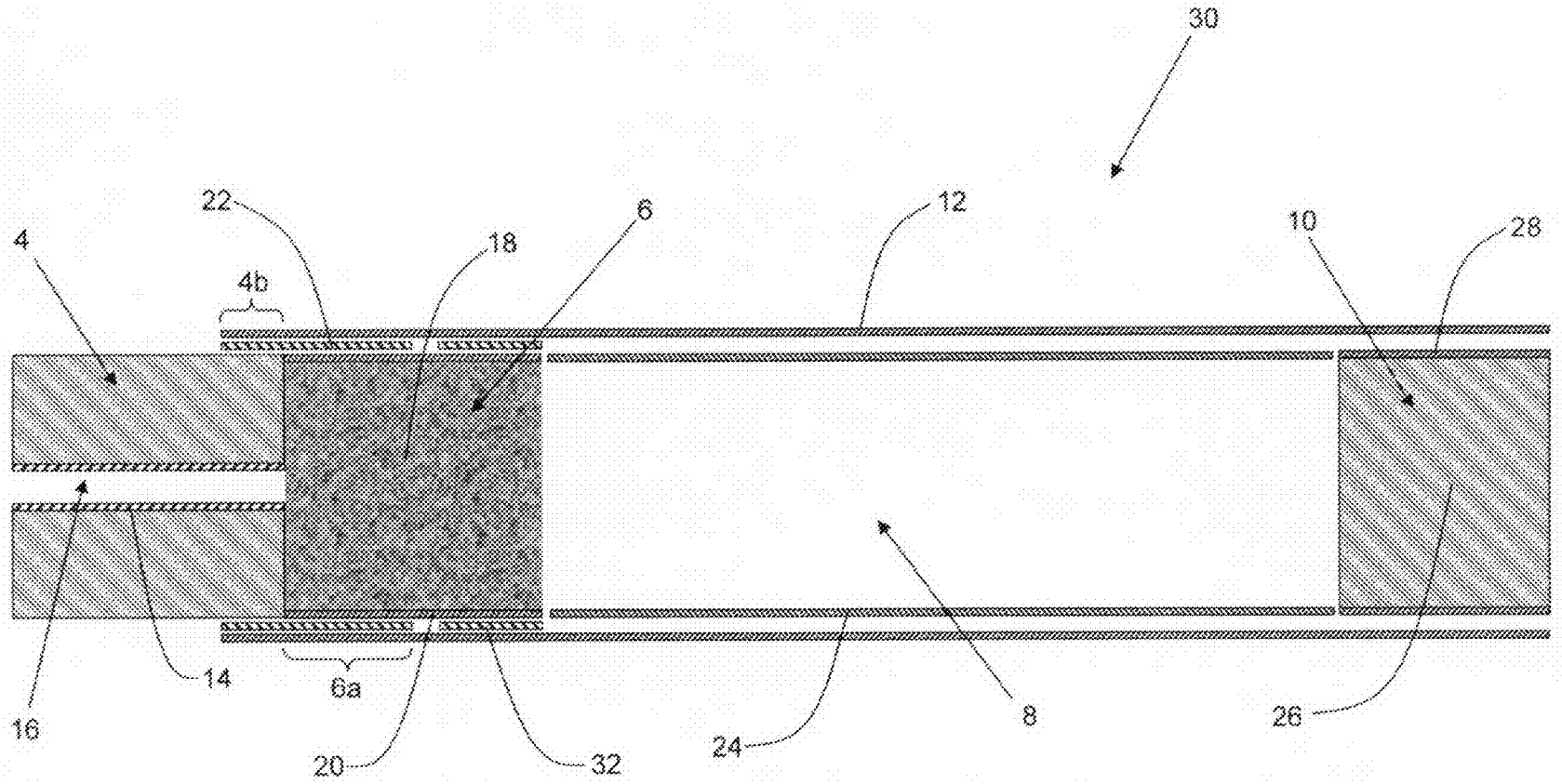
FIG. 2 shows a schematic longitudinal cross-section of a smoking article according to a second preferred embodiment of the invention having the dimensions and features given in column 3 of Table 1.

The cigarette-like smoking article 30 according to the second preferred embodiment of the invention shown in FIG. 2 is of largely similar construction and design as the smoking article 2 according to the first preferred embodiment of the invention shown in FIG. 1. The only difference between the cigarette-like smoking article 2 according to the first preferred embodiment of the invention shown in FIG. 1 and the cigarette-like smoking article 30 according to the second preferred embodiment of the invention shown in FIG. 2 is that the smoking article 30 further comprises an open ended cylindrical sleeve 32 of aluminium foil downstream of the heat-conducting element 22. As shown in FIG. 2, the sleeve 32, which is spaced apart from the heat-conducting element 22, surrounds and is in contact with a rear portion of the aerosol-generating substrate 6. The dimensions and further features of the cigarette-like smoking article 2 and its components are given in Table 1 (see column 3).

Figure 3:
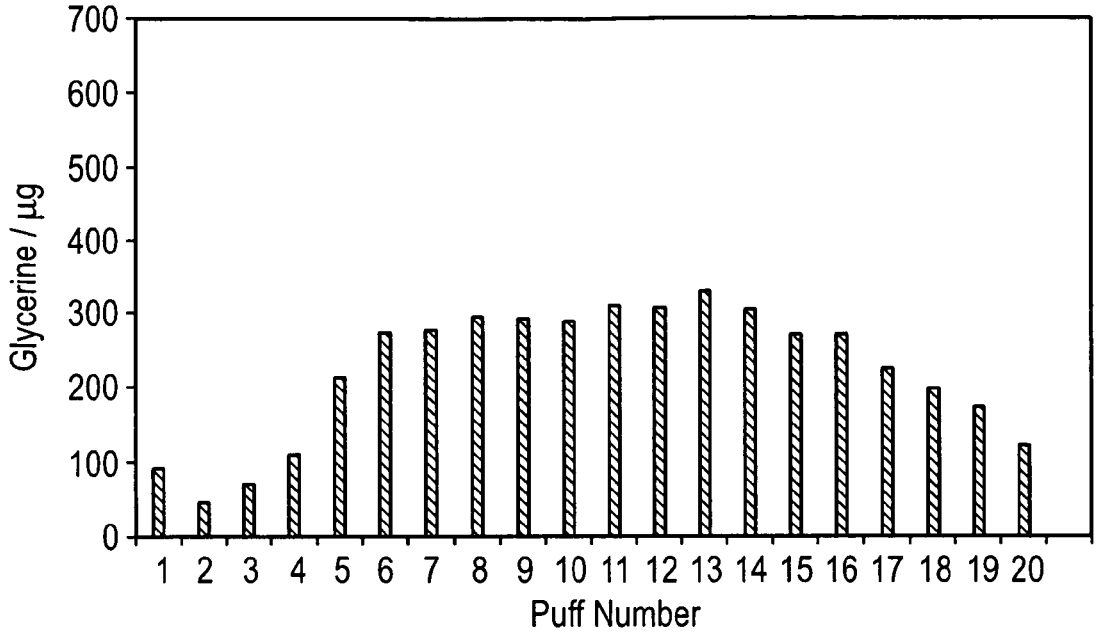
FIG. 3 shows a graph of the amounts of aerosol former (glycerine) delivered per puff for a smoking article according to the first preferred embodiment of the invention shown in FIG. 1.

A smoking article according to the first preferred embodiment of the invention shown in FIG. 1 having the dimensions shown in column 1 of Table 1 is produced as described above and the amounts of glycerine (in micrograms) per puff are measured as a function of puff number. The results are shown in FIG. 3 (puff-by-puff profile). For comparison, a smoking article not according to the invention having the dimensions and features shown in column 2 of Table 1 is produced. The amounts of glycerine per puff are also measured as a function of puff number; the results are shown in FIG. 4 (puff-by-puff profile).

The smoking article according to the first preferred embodiment of the invention and the smoking article not according to the invention differ only in the length of the aerosol-generating substrate covered by the heat-conducting element; the combustible heat sources, aerosol-generating substrates, expansion chambers, mouthpieces and all other dimensions of the smoking articles are identical. In the smoking article not according to the invention the heat-conducting element covers the entire length of the aerosol-generating substrate. In other words, the heat-generating substrate does not extend downstream beyond the heat-conducting element. The smoking article not according to the invention is otherwise of identical construction as the smoking article according to the first preferred embodiment of the invention.

Figure 4:
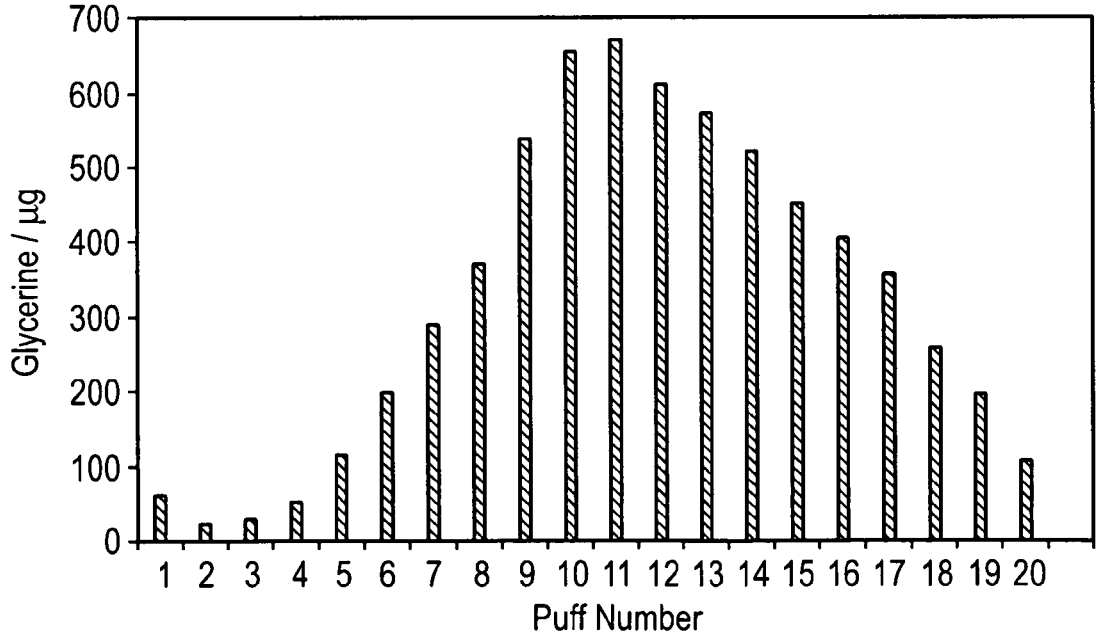
FIG. 4 shows a graph of the amounts of aerosol former (glycerine) delivered per puff for a smoking article not according to the invention having the dimensions and features given in column 2 of Table 1.

To generate the puff-by-puff profiles shown in FIGS. 3 and 4, the smoking articles are equilibrated at 22° C. and 50% relative humidity for 2 days. The smoking articles are lit through resistive heating by applying a current across the carbon heat source through electrodes placed about 1 mm in front of the heat-conducting element. A puff of 60 ml (puff volume) is taken in 2 seconds (puff duration) every 30 seconds (puff frequency).

The semi-quantitative method that provides the semi-quantitative determination of glycerine in the aerosol of the smoking articles on a puff by puff basis is as follows:

An ultra-fast capillary gas chromatograph (GC) linked to a time-of-flight mass spectrometer is interfaced with a fully automated syringe sampling system comprising a 1 ml gas syringe, drawing from the aerosol as it exits the mouth end of the smoking articles while a puff is taken. The GC is operated isothermally at 200° C. Sampling and purging of the system are synchronised to puff actuation. The values shown in FIGS. 3 and 4 are averages of 3 determinations. Only relative profiles are acquired, the yields are derived from the quantification of the condensate collected over the total of a smoking run.

As illustrated by the puff-by-puff glycerine delivery profiles shown in FIGS. 3 and 4, the extension of the aerosol-generating substrate downstream beyond the heat-conducting element in the smoking article according to the first preferred embodiment of the invention advantageously gives rise to substantially consistent delivery profiles as compared to the inconsistent delivery profiles obtained for a smoking article wherein the aerosol-generating substrate does not extend downstream beyond the heat-conducting element. The partial coverage of the aerosol-generating substrate by the heat-conducting element in the smoking article according to the first preferred embodiment of the invention generally results in an increase in the amounts of glycerine in initial puffs and a decrease in the amounts of glycerine in subsequent puffs compared to the smoking article not according to the present invention with complete coverage.

A good indication for an aerosol of substantially consistent strength or intensity is the relative flatness of the puff-by-puff glycerine delivery profiles between puffs 5 and 17. A good indication for an inconsistent composition of the aerosol is the sideways shift of the glycerine delivery profile in FIG. 4.

TABLE 1

| Smoking article | 1 | 2 | 3 |
|---|---|---|---|
| Overall length (mm) | 70 | | |
| Diameter (mm) | 7.9 | | |
| Porous carbon-based heat source | | | |
| Length (mm) | 11 | | |
| Diameter (mm) | 7.8 | | |
| Density (g/cm$^3$) | 0.7 | | |
| Porosity (%) | 64 | | |
| Diameter of airflow channel (mm) | 2 | | |
| Thickness of ceramic coating (μm) | 80 | | |
| Aerosol-generating substrate | | | |
| Length (mm) | 10 | | |
| Diameter (mm) | 7.8 | | |
| Density (g/cm$^3$) | 0.8 | | |
| Aerosol former | Glycerine | | |
| Expansion chamber | | | |
| Length (mm) | 42 | | |
| Diameter (mm) | 7.8 | | |
| Mouthpiece | | | |
| Length (mm) | 7 | | |
| Diameter (mm) | 7.8 | | |
| Heat-conducting element | | | |
| Length (mm) | 9 | 14 | 9 |
| Diameter (mm) | 7.8 | | |
| Thickness of aluminium foil (μm) | 20 | | |
| Sleeve | | | |
| Length (mm) | — | | 4 |
| Diameter (mm) | — | | 7.8 |
| Thickness of aluminium foil (μm) | — | | 20 |
| Length of the rear portion of the combustible heat source (mm) | 4 | 4 | 4 |
| Length of the front portion of the aerosol-generating substrate (mm) | 5 | 10 | 5 |
| Length of the rear portion of the aerosol-generating substrate (mm) | 5 | 0 | 5 |
| Separation between the heat-conducting element and the sleeve (mm) | — | | 1 |
| Length of the rear portion of the aerosol-generating substrate surrounded by the sleeve (mm) | — | | 4 |

The invention claimed is:

1. A smoking article comprising:

a combustible heat source;

an aerosol-generating substrate downstream of the combustible heat source; and a heat-conducting element around and in contact with a rear portion of the combustible heat source and an adjacent front portion of the aerosol-generating substrate, wherein the aerosol-generating substrate extends at least about 3 mm downstream beyond the heat-conducting element.

2. A smoking article according to claim 1 further comprising a sleeve around a rear portion of the aerosol-generating substrate, wherein the sleeve is downstream of and spaced apart from the heat-conducting element.

3. A smoking article according to claim 1 wherein the front portion of the aerosol-generating substrate abuts the rear portion of the combustible heat source.

4. A smoking article according to claim 1 wherein the rear portion of the combustible heat source and the front portion of the aerosol-generating substrate are of substantially the same dimensions.

5. A smoking article according to claim 1 further comprising:

an expansion chamber downstream of the aerosol-generating substrate.

6. A smoking article according to claim 5 further comprising:

a mouthpiece downstream of the expansion chamber.

7. A smoking article according to claim 1 wherein the combustible heat source is a porous carbon-based heat source.

8. A smoking article according to claim 1 wherein the aerosol-generating substrate comprises homogenised tobacco-based material.

9. A smoking article according to claim 1 wherein at least one longitudinal airflow channel is provided through the combustible heat source.

10. A smoking article according to claim 9 wherein a coating is provided on the inner surface of the at least one airflow channel.

11. A smoking article according to claim 1 wherein the aerosol generating substrate comprises an aerosol former having a boiling point below about 350° C.

12. A smoking article according to claim 1 wherein the combustible heat source comprises a cylinder of pyrolysed carbon having a density of about 0.5 to 0.8 g/cm$^3$ and a porosity of about 60 to 65%.

13. A smoking article according to claim 10 wherein the coating has a thickness of 30 to 200 microns.

14. A smoking article according to claim 1 wherein the aerosol generating substrate comprises a cylinder of plant material circumscribed by a plug wrap.

15. A smoking article according to claim 1 wherein the aerosol generating substrate comprises 5 to 40% by weight tobacco material.

16. A smoking article according to claim 1 wherein the heat conducting element surrounds about 30 to 60% of the length of the aerosol generating substrate.

17. A smoking article according to claim 2 wherein the sleeve and the heat conducting element are of the same material and separated by a gap of at least about 0.5 mm.

18. A smoking article according to claim 5 wherein the expansion chamber comprises a hollow tube.

19. A smoking article according to claim 6 wherein the mouthpiece is a reusable mouthpiece which is detachable from the smoking article.

20. A smoking article according to claim 1 having a length of about 70 to 100 mm and diameter of about 5 to 9 mm, the aerosol generating substance has a length of about 5 to 20 mm and the combustible heat source has a length of about 7 to 17 mm.

* * * * *